US008646239B2

(12) United States Patent
Rulon

(10) Patent No.: US 8,646,239 B2
(45) Date of Patent: Feb. 11, 2014

(54) MODULAR BUILDING BLOCK BUILDING SYSTEM

(76) Inventor: John David Rulon, Rutherford, CA (US)

( * ) Notice: Subject to any disclaimer, the term of this patent is extended or adjusted under 35 U.S.C. 154(b) by 0 days.

(21) Appl. No.: 13/196,888

(22) Filed: Aug. 3, 2011

(65) Prior Publication Data

US 2012/0031031 A1 Feb. 9, 2012

Related U.S. Application Data

(60) Provisional application No. 61/370,758, filed on Aug. 4, 2010.

(51) Int. Cl.
*E04C 1/00* (2006.01)

(52) U.S. Cl.
USPC ..... 52/606; 52/600; 52/309.7; 52/223.7

(58) Field of Classification Search
USPC ..... 52/561–572, 503–505, 309.4, 309.7, 52/223.1, 223.6, 223.7, 600, 603, 606
See application file for complete search history.

(56) References Cited

U.S. PATENT DOCUMENTS

| | | | | | |
|---|---|---|---|---|---|
| 868,838 | A | | 10/1907 | Brewington | |
| 995,008 | A | * | 6/1911 | Jackson | 52/223.6 |
| 1,685,353 | A | | 11/1924 | Dawson et al. | |
| 2,076,728 | A | | 3/1933 | Keller | |
| 2,061,281 | A | | 12/1933 | Lawlor | |
| 2,145,496 | A | | 6/1934 | Reinhard | |
| 2,102,447 | A | * | 12/1937 | Whitacre | 52/223.7 |
| 2,202,745 | A | | 3/1938 | Muse | |
| 2,176,986 | A | * | 10/1939 | Briscoe | 52/293.2 |
| 2,184,137 | A | * | 12/1939 | Brewer | 52/223.7 |
| 2,482,719 | A | | 1/1944 | Rigaumont | |
| 2,619,829 | A | | 6/1948 | Tatum | |
| 2,751,776 | A | * | 6/1956 | Streblow et al. | 52/223.7 |
| 2,776,559 | A | * | 1/1957 | Summers | 52/442 |
| 3,339,326 | A | | 7/1964 | Derr et al. | |
| 3,209,510 | A | * | 10/1965 | Nakanishi | 52/745.17 |
| 3,239,982 | A | * | 3/1966 | Nicosia | 52/309.7 |
| 4,143,501 | A | | 3/1979 | Tuttle | |

(Continued)

OTHER PUBLICATIONS

Khoshnevis, Behrokh. "Contour Crafting: Automated Construction." Kurzweil Accelerated Intelligence videos, Aug. 4, 2012, [Retrieved on Aug, 31, 2012]. Retrieved from the Internet: <URL: http://www.kurzweilai.net/behrokh-khoshnevis-contour-crafting-automated-construction?utm_source=KurzweilAI+Daily+Newsletter&utm_campaign=f5eedd55c6-UA-946742-1&utm_medium=email>.

*Primary Examiner* — Brent W Herring
(74) *Attorney, Agent, or Firm* — Dorsey & Whitney LLP

(57) ABSTRACT

A system and method for constructing and using modular building blocks. The blocks may include two walls, a course, end conditions, a reinforcing assembly, and vertical and lateral retaining members. The walls may include lateral supports disposed lengthwise on a top and a bottom surface. Lateral retainer members may be disposed into the lateral supports. The walls may also include channels extending from the top surface to the bottom surface. Vertical retainer members may be disposed into the channels. The course may be disposed between and coupled to the walls and characterized by one or more turns. The reinforcing assembly may be set inside the walls and the course. The reinforcing assembly may include wire mesh portions disposed to form interlocks, where the interlocks provide structural support for the channels. The modular building blocks may be coupled together with structurally complimentary end conditions.

13 Claims, 13 Drawing Sheets

(56) References Cited

U.S. PATENT DOCUMENTS

| | | | | |
|---|---|---|---|---|
| 4,223,053 | A | 9/1980 | Brogan | |
| 4,651,485 | A * | 3/1987 | Osborne | 52/284 |
| 5,317,848 | A | 6/1994 | Abbey | |
| 5,596,853 | A * | 1/1997 | Blaney et al. | 52/223.7 |
| 5,680,735 | A | 10/1997 | Bates | |
| 6,076,323 | A | 6/2000 | Chiu | |
| 6,282,853 | B1 * | 9/2001 | Blaney et al. | 52/223.7 |
| 6,513,293 | B2 * | 2/2003 | Miller | 52/405.1 |
| 7,393,577 | B2 | 7/2008 | Day et al. | |
| 7,546,712 | B2 * | 6/2009 | Shaw | 52/223.8 |
| 7,669,384 | B2 * | 3/2010 | Kaida et al. | 52/790.1 |
| 2005/0034386 | A1 | 2/2005 | Crandell et al. | |
| 2006/0101749 | A1 | 5/2006 | Aota et al. | |
| 2006/0213138 | A1 | 9/2006 | Milani et al. | |
| 2007/0022684 | A1 * | 2/2007 | Haener | 52/286 |
| 2007/0060012 | A1 | 3/2007 | Comfort | |
| 2007/0068106 | A1 | 3/2007 | Mangano | |
| 2007/0137136 | A1 | 6/2007 | Hollon | |
| 2008/0250739 | A1 * | 10/2008 | Krupinski et al. | 52/309.4 |
| 2009/0038255 | A1 | 2/2009 | Knauf | |
| 2009/0107054 | A1 | 4/2009 | Waller | |
| 2009/0193740 | A1 * | 8/2009 | Bennett | 52/309.1 |
| 2009/0229214 | A1 | 9/2009 | Nelson | |
| 2009/0308017 | A1 | 12/2009 | Kadoya et al. | |
| 2009/0321586 | A1 | 12/2009 | Kabat et al. | |
| 2010/0095603 | A1 | 4/2010 | DeFilipp | |
| 2011/0072753 | A1 * | 3/2011 | MacDonald | 52/562 |

* cited by examiner

MODULAR BUILDING BLOCK BUILDING SYSTEM

CROSS REFERENCE TO RELATED APPLICATION

This application claims the benefit of provisional patent application No. 61/370,758 entitled "AieroBloc Autoclaved Aerated Concrete Modular Block Building System" by the same inventor filed on Aug. 4, 2010 which is incorporated as if fully set forth herein.

BACKGROUND OF THE INVENTION

Conventional building block structures employ blocks that are prefabricated in an off-site factory then transported to the construction site for assembly. The blocks are then disposed in courses and supported on a concrete foundation. Considerable skill and care is required to accomplish properly-aligned and level courses, resulting in high labor costs. This design is time consuming and leaves room for mistakes and omissions due to errors, lack of expertise or incompetence that occur in the field.

Attempts have been made to create an easily assembled building block structure. These structures have conventionally relied on the blocks as a load-carrying element. Thus, in order to sustain loads, the blocks require sufficiently strong and durable material to withstand the stresses of the loads. A disadvantage of the design is that the blocks are heavy in weight and expensive to manufacture.

As such, there is a need for a structural construction system, which provides a lightweight yet reliably strong building block that can withstand stresses caused from loads and other forces such as seismic activity and weather. Moreover a reinforced concrete structure that incurs a reduced transportation cost due to a reduction in weight of the prefabricated blocks and reduced labor costs, which come from installation, would be beneficial. In addition, a structural construction system that is pre-engineered to incorporate reinforcement within the block and provide a means to tie each block together with simple standard components would also be beneficial.

SUMMARY OF THE INVENTION

The present invention details a system and method for construction of a structure using modular building blocks. The modular building block may include two walls, a course connecting the two walls, one or more end conditions, a reinforcing assembly, at least one vertical retaining member and a lateral retaining member. The walls may include lateral supports disposed lengthwise on a top and a bottom surface. The lateral supports may provide a more positive engagement for multiple modular building blocks and protection from forces caused by seismic activity, weather or other harmful factors. The lateral supports may be provided through the use of structural elements such as a raised portion on the top surface and complimentary dimples on the bottom surface. Alternatively, the lateral supports may be provided through the use of recesses on the top and bottom surfaces and lateral retainer members disposed in those recesses. The walls may also include channels extending from the top surface to the bottom surface. Vertical retainer members may be disposed into the channels. The vertical retainers may also provide more positive engagement for multiple modular building blocks and protection against forces caused by seismic activity, weather or other harmful factors.

End conditions may be employed that allow for coupling different shapes modular building blocks and to allow for a wide range of building structures. The end conditions may optimize connecting various modular building blocks to effect walls, lintels, and floors. Moreover end conditions may be effectuated to provide for many different shapes wall and window structures.

The course may be disposed between and coupled to the walls and characterized by one or more turns. The reinforcing assembly may be set inside the walls and the course to provide a more structurally sound modular building block. The reinforcing assembly may include wire mesh portions disposed to form interlocks, where the interlocks provide structural support for the channels. The modular building blocks may be coupled together with structurally complimentary end conditions.

The modular building blocks may be assembled in running bond pattern, stacked pattern, or other patterns to form walls and other structures. Similarly constructed modular building blocks may be assembled to form floors, door and window frames. They may also provide space for integrated plumbing, electrical and heating ventilation air conditioning (HVAC) systems within the chases and voids of the modular building block. In addition to conditioned air being directed to interior spaces, the conditioned air may heat or cool the modular building blocks. The modular building blocks would then be a source or a receptor of radiant heat energy to heat or cool the adjacent interior space. The result of this is a combination forced air and radiant system for heating and cooling interior spaces. The modular building blocks may be filled with phase change material to control climate condition within the structure. Phase change material allows for additional thermal mass to be added to the modular building blocks without adding a great deal of weight. The amount of thermal mass in the block can be adjusted to the climate conditions where the structure is built.

The modular building blocks may be lightweight, fireproof, pest proof, rot proof and may incorporate the structural reinforcing to withstand seismic and harmful weather forces, such as hurricanes. This would allow people without many resources to build safe quality structures in an easy and cost effective way that is environmentally responsible. This design may be cost effective, durable, fire resistant, mold resistant, pest resistant, and offer good thermal and acoustical insulation, improved air quality and simplified construction.

The construction and method of operation of the invention, however, together with additional objectives and advantages thereof will be best understood from the following description of specific embodiments when read in connection with the accompanying drawings.

DESCRIPTION

Figure 1A:
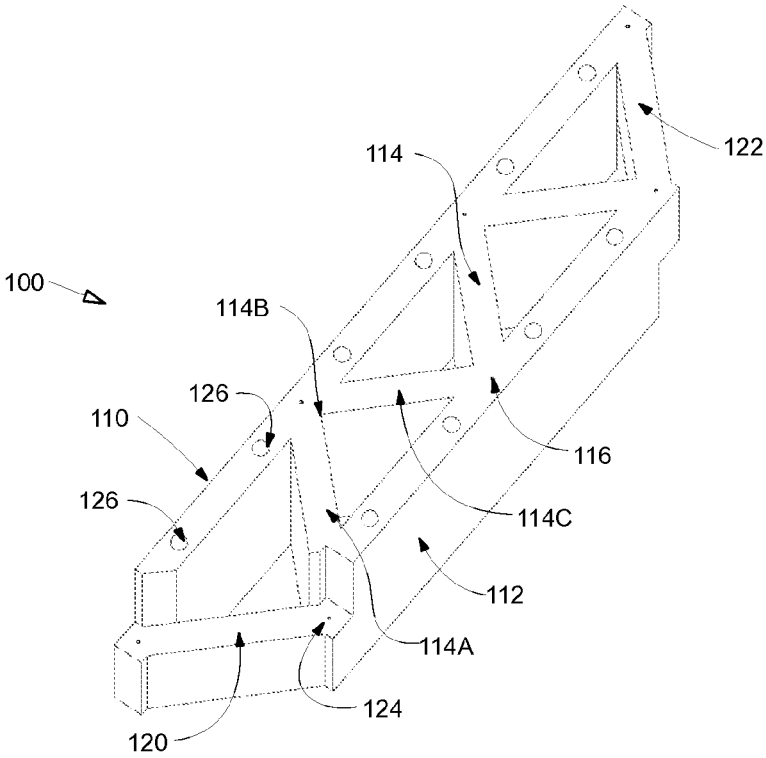
FIG. 1A illustrates a modular building block with raised portion dimple lateral supports according to certain aspects of the current disclosure.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Lexicography

Read this application with the following terms and phrases in their most general form. The general meaning of each of these terms or phrases is illustrative, not in any way limiting.

The term "course" generally refers to structure characterized by turns in alternating directions. A course may be made of concrete, plastic, wood, and other materials used in construction.

The term "lateral support" generally refers to a physical support to help provide a more positive engagement so as to prevent the blocks from sliding out of position when shear forces are applied.

The term "end condition" generally refers to an end of a modular building block that is shaped to structurally complement and couple with an end of an adjacent modular building block.

DETAILED DESCRIPTION

FIG. 1A illustrates a modular building block 100 according to certain aspects of the current disclosure. In FIG. 1, the modular building block 100 has a first wall 110, a second opposing wall 112, and a course 114 characterized by turns in alternating directions. The course 114 comprises a first length 114A, an angle 114B, and a second length 114C. The first length 114A spans between the first wall 110 and the second opposing wall 112. At the end of the first length 114A, the course 114 turns in the alternate direction having the angle 114B. The course 114 then continues from the angle 114B to span the second length 114C between the first wall 110 and the second opposing wall 112. In FIG. 1, the angle 114B is shown as 90 degrees, however, one skilled in the art would recognize that the course 114 can be constructed to effect other types of structural supports between the first wall 110 and the second wall 112. The span of the course 114, the first and second walls 110, 112 can be lengthened or shorted as needed. The intersection of the course 114 and either of the first or second wall 110, 112 has a tube 116. The tube 116 passes completely through the modular building block 100. The inventor contemplates using a tube, however, one skilled in the art would recognize other means to effectuate a channel.

Lateral Support

Figure 1B:
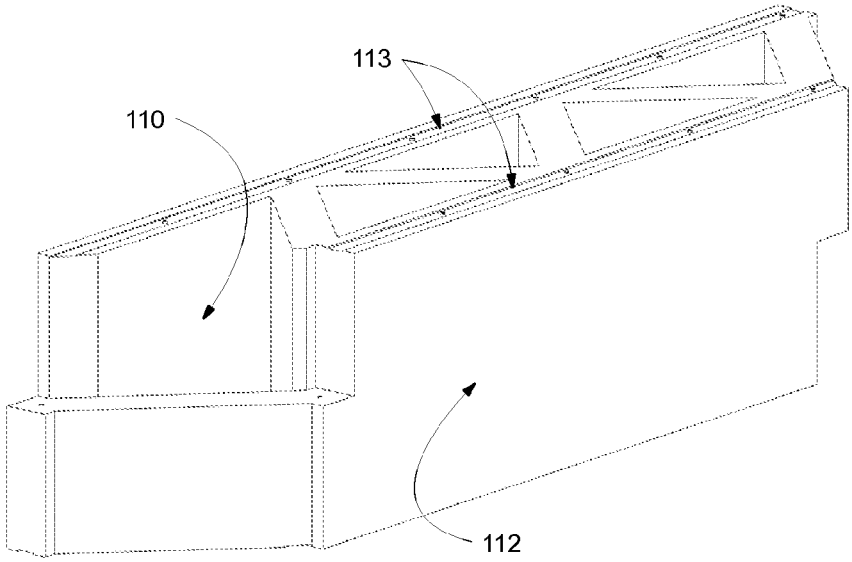
FIG. 1B illustrates a modular building block with recess lateral supports according to certain aspects of the current disclosure.

In FIG. 1B a first wall 110 and a second wall 112 have a recess 118 laid lengthwise across the top and bottom (not shown) surfaces. The recess 118 overlaps with the tubes 116. Alternatively, lateral support can be provided through the use of structural elements such as a raised portion on the top surface and complimentary dimples on the bottom surface. Shown in FIG. 1A, these raised portions and dimples may be spaced at locations 126 across the top and bottom surfaces of the first wall 110 and the second wall 112. The raised portions and dimple support aids registration of the modular building blocks during construction so that when a block is disposed on top of another block it is suitably positioned. Moreover this type of lateral support may provide a more positive engagement so as to prevent the blocks from sliding out of position when shear forces are applied. One having skill in the art would realize that the raised portion and dimples may be effectuated using different shapes for example but not limited to a truncated pyramid.

The modular building block 100 has a first end condition 120 and a second end condition 122. The first end condition 120 of the modular building block 100 is shaped to structurally complement and couple with another end condition of an adjacent modular building block. The second end condition 122 of the modular building block 100 is shaped to structurally complement and couple with another end condition of an adjacent modular building block. The first end condition 120 and the second end condition 122 have a tube 124 that completely passing through the first and second end conditions 120, 122. The tube 124 in the first end condition 120 of the modular building block 100 is disposed to align with the tube 124 in another end condition of an adjacent modular building block. The tube 124 in the second end condition 122 of the modular building block 100 is disposed to align with the tube 124 in another end condition of an adjacent modular building block.

The inventor contemplates using cellular lightweight concrete (CLC) to form the modular building block 100. This would allow the modular building block 100 to be durable, cost effective, fire, mold, and pest resistant, to provide a good thermal and acoustical insulation, to improve air quality and to simplify construction. However, one skilled in the art would recognize that other materials may be used to effectuate a lightweight, strong, durable, and easy to construct modular building block. For example a designer may choose any material capable of withstanding forces caused by seismic activity, weather or other harmful factors.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effect such feature, structure or characteristic in connection with other embodiments whether or not explicitly described. Parts of the description are presented using terminology commonly employed by those of ordinary skill in the art to convey the substance of their work to others of ordinary skill in the art.

Figure 2:
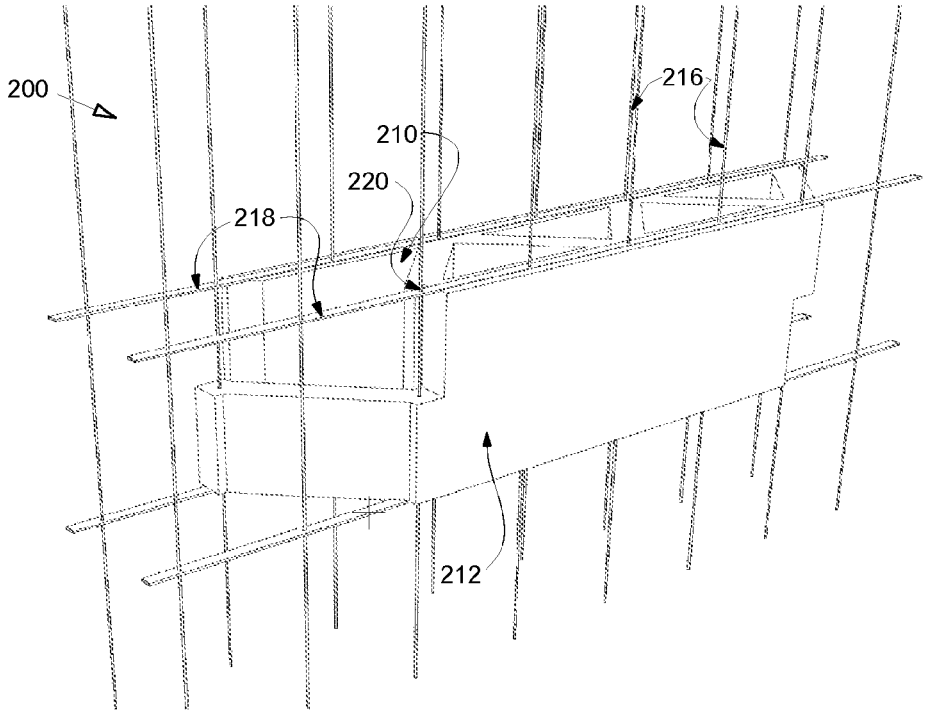
FIG. 2 illustrates a modular building block having additional coupling elements according to certain aspects of the current disclosure.

FIG. 2 illustrates a modular building block 200 having additional coupling elements according to certain aspects of the current disclosure. The modular building block 200 has a tube (similar to tube 116 as shown in FIG. 1), which completely passes through a first wall 210 and a second wall 212. The tube houses a rod 216. The rod 216 is independently inserted into the tube and completely passes through the modular building block 200. The inventor contemplates using a rod, however, one skilled in the art would recognize other means to effectuate a retainer member capable of withstanding forces caused by seismic activity, weather or other harmful factors. The rod 216 may be used to couple the modular building block 200 to another modular building block as described below.

The first wall 210 and the second wall 212 have a tie strap 218 laid lengthwise across the top and bottom surfaces. The tie strap 218 lays in a recess that runs along the top and bottom surfaces of the first and second walls 210, 218 similar to the recess shown in FIG. 1. The tie strap 218 has a hole 220, which aligns with the placement of the rod 216 and allows the rod 216 to pass completely through the tie strap 218. This enables the tie strap 218 to couple the modular building block 200 with another modular building.

The inventor contemplates using steel to form the rod 216 and the tie strap 218. However, one skilled in the art would recognize that other materials may be used to effectuate strong and durable coupling elements.

Figure 3:
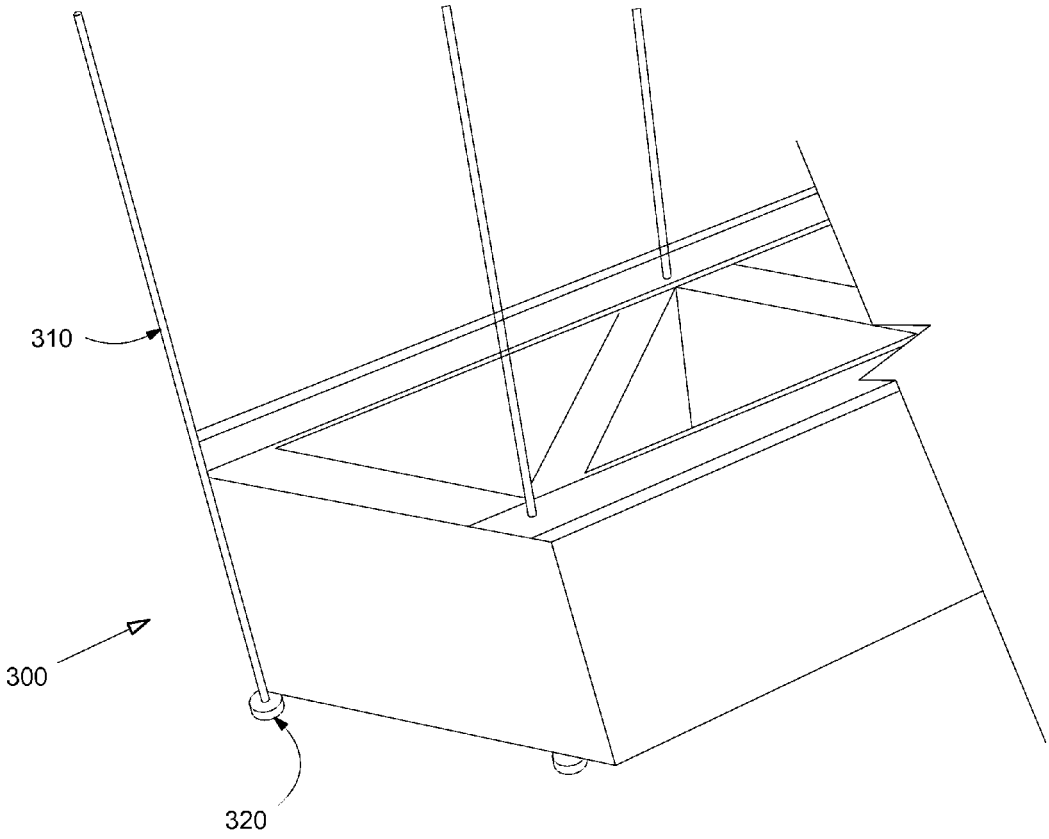
FIG. 3 illustrates a portion of a modular building block having tensioned coupling elements.

FIG. 3 illustrates a modular building block 300 having tensioned coupling elements. A rod 310 passes completely through the modular building block 300 as described above. The rod 310 is tensioned with a fastener 320. For example and without limitation the rod 310 may be threaded and tensioned with the fastener 320 using a nut.

Alternatively, the tubes themselves may be partially or completely threaded. This would allow for threaded rods to be screwed into the tubes, either completely through the blocks or shortened rods extending partially into each of two blocks.

Figure 4:
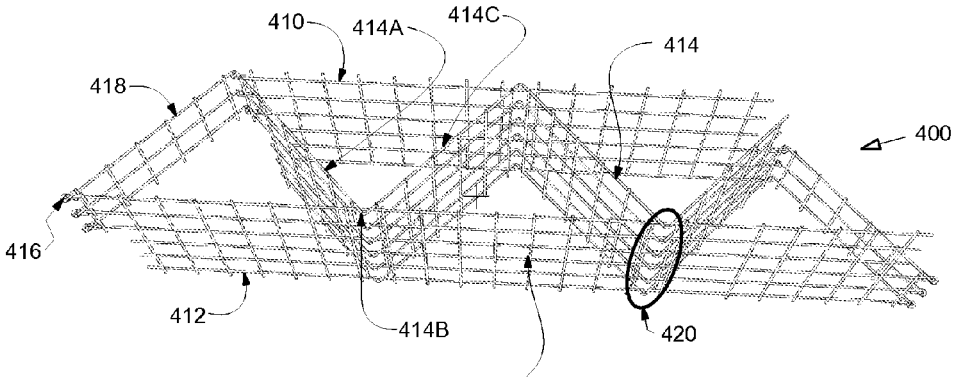
FIG. 4 shows a reinforcing assembly for a modular building block.

FIG. 4 shows a reinforcing assembly 400 for a modular building block. In FIG. 4, the reinforcing assembly 400 has a first panel 410, a second opposing panel 412, and a course 414 characterized by turns in alternating directions. The course 414 comprises a first length 414A, a turn 414B, and a second length 414C. The first length 414A spans from the first panel 410 to the second opposing panel 412. At the end of the first length 414A, the course 414 bends in the alternate direction having the turn 414B. The turn 414B extends beyond the second panel 412 leaving a gap between the course 414 and the second panel 412, forming an interlock 420. The course 414 then continues from the turn 414B to the second length 414C spanning between the second panel 412 and the first panel 410. In FIG. 4, the turn 414B is shown as 90 degrees, however, one skilled in the art would recognize that the course 414 can be constructed to effect other types of structural supports between the first panel 410 and the second panel 412. The course 414 repeats this pattern across the length of the reinforcing assembly 400. To accommodate for a chase in a modular building block a through hole (not shown) is cut away from the course 414. The through hole (not shown) span the length of the course 414 and is disposed next to either the first panel 410 or the second panel 412 but does not extend to the opposite panel.

The ends of the first and second panels 410, 412 and the course 414 have a plurality of loop ties 416 where the course 414 and either of the first panel 410 or second panel 412 intersect. An end condition 418 of the reinforcing assembly is shaped to structurally complement and couple with another end condition of an adjacent reinforcing assembly. The inventor contemplates using steel welded wire mesh to form the reinforcing assembly 400. However, one skilled in the art would recognize that other materials may be used to effectuate a lightweight, strong, durable, and easy to construct reinforcing assembly, such as but not limited to basalt mesh reinforcement. Basalt mesh reinforcement may be lighter, stronger, and non corrosive thus requiring less coverage of concrete.

Alternatively the reinforcement assembly may be made using conventional reinforcements, such as rebar and wire ties casted into a modular building block.

Figure 5:
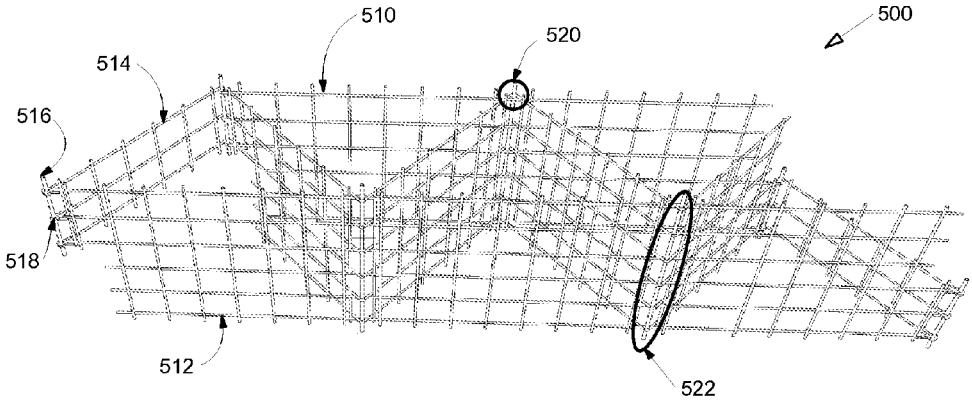
FIG. 5 illustrates a coupled reinforcing assembly.

FIG. 5 illustrates a coupled reinforcing assembly 500. The reinforcing assembly 500 having a first panel 510, a second panel 512, and a course 514 are assembled similar to that described and shown in FIG. 4. The first panel 510, the second panel 512, and the course 514 are coupled via a tube 516. The inventor contemplates using a tube, however, one skilled in the art would recognize other means to effectuate a channel. The ends of the first panel 510, the second panel 512 and the course 514 have a plurality of loop ties 518. The tube 516 is inserted through the loop ties 518 and couples the course 514 to either the ends of the first panel 510 or the ends of the second panel 512. The course 514 has a turn 520, which intersects with the first and second panels 510, 512 creating an interlock 522. The tube 516 is inserted in the interlock 522 between the turn 520 and the first panel 510 or the turn 520 and the second panel 512 to couple the course 514 to either the first or second panel 510, 512. The coupled reinforcing assembly may be disposed in the modular building block by casting the coupled reinforcing assembly in concrete.

Figure 6:
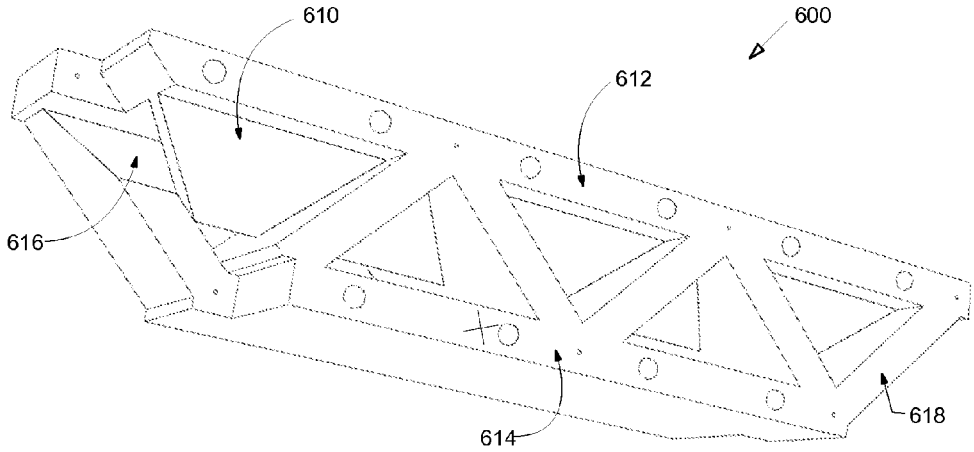
FIG. 6 depicts a modular building block with an optional chase.

FIG. 6 depicts a side view of a modular building block 600 with an optional chase 610. The chase 610 is positioned against the middle of a first wall 612 but does not extend to a second wall 614. The chase 610 shown in FIG. 6 has a triangular shape however, one skilled in the art would recognize that the chase 610 can be otherwise constructed to effect a means for running piping, wiring, or the like. The chase 610 runs along the length of the modular building block 600. FIG. 6 shows the chase 600 enclosed by walls; however, one skilled in the art would recognize the chase 610 may be left open to provide for running piping, wiring or the like in both the horizontal and vertical directions. The modular building block 600 has a first end condition 616 and a second end condition 618. The first end condition 616 of the modular building block 600 is shaped to structurally complement and couple with another end condition of an adjacent modular building block. The second end condition 618 of the modular building block 600 is shaped to structurally complement and couple with another end condition of an adjacent modular building block.

Figure 7:
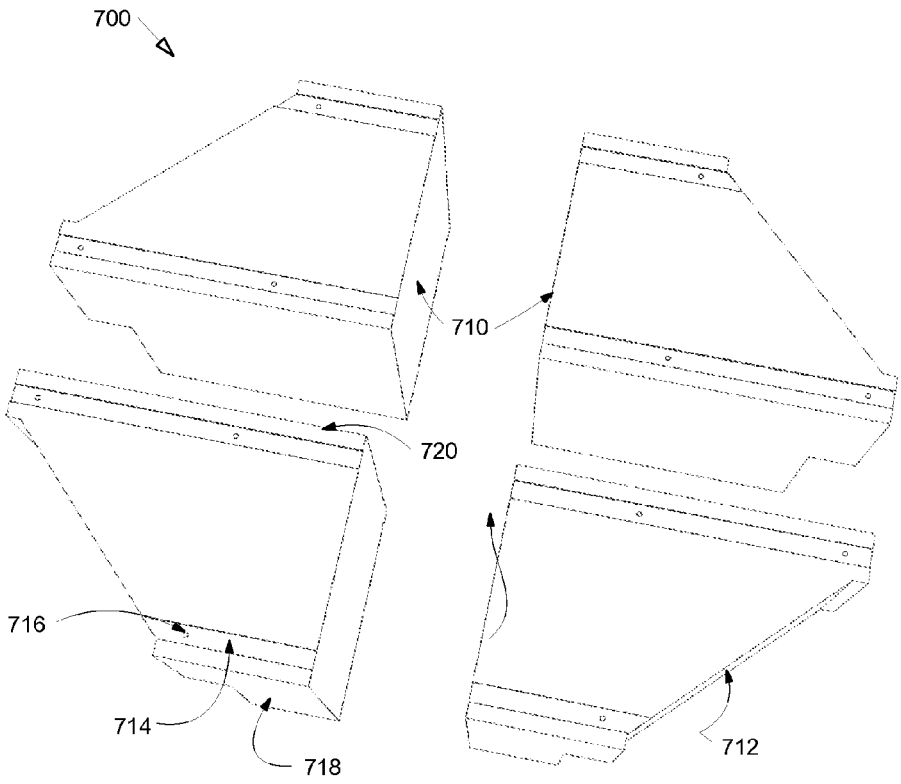
FIG. 7 illustrates a plurality of jam/end blocks used in the assembly of modular building blocks.

FIG. 7 illustrates a plurality of jam/end blocks 700 used in the assembly of modular building blocks. The jam/end blocks 700 have an end condition 712 and an end wall 710. The end condition 712 is shaped to structurally complement and couple with another end condition of an adjacent modular building block. The jam/end blocks 700 have a tube 716, which passes completely through and are cast into the jam/end blocks 700. The inventor contemplates using a tube, however, one skilled in the art would recognize that there are other means to effectuate a channel. In FIG. 7 a first wall 718 and a second wall 720 have a recess 714 laid lengthwise across the top and bottom (not shown) surfaces. The recess 714 overlaps with the tubes 716. The recess 714 and the tube 716 provide lateral support when assembling the modular building blocks.

Figure 8:
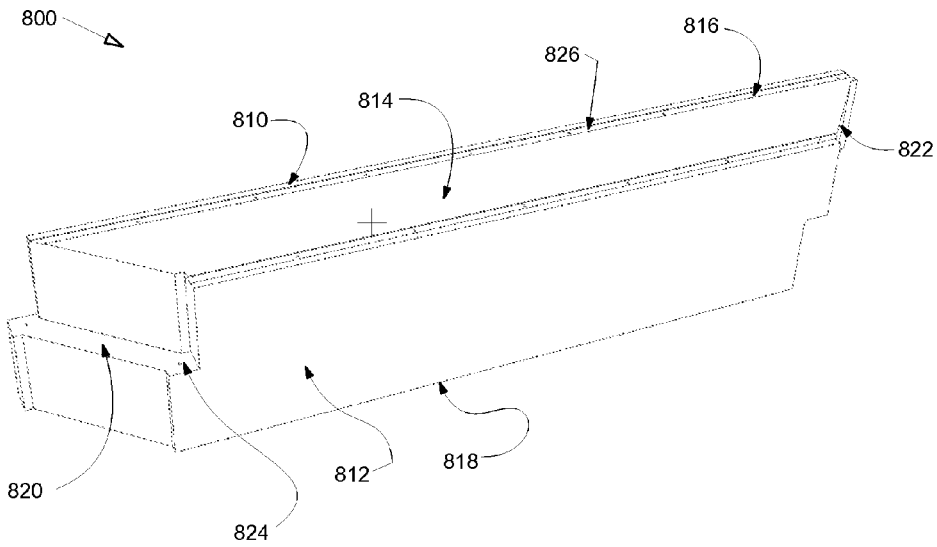
FIG. 8 depicts a lintel block.

FIG. 8 depicts a plurality of lintel blocks 800. In FIG. 8, the lintel block 800 has a first wall 810, a second opposing wall 812, a third top wall 814, and a fourth bottom wall 818 (not shown). Along the first wall 810 and the second wall 812 is a tube 816. The tube 816 passes completely through the lintel block 800. The inventor contemplates using a tube, however, one skilled in the art would recognize other means to effectuate a channel.

In FIG. 8 a first wall 810 and a second wall 812 have a recess 826 laid lengthwise across the top and bottom (not shown) walls 814, 818. The recess 118 overlaps with the tubes 116. This type of lateral support may provide a more positive engagement so as to prevent the blocks from sliding out of position when shear forces are applied. One having skill in the art would realize that the raised portion and dimples may be effectuated using different shapes for example but not limited to a truncated pyramid.

The lintel block 800 has a first end condition 820 and a second end condition 822. The first end condition 820 of the lintel block 800 is shaped to structurally complement and couple with another end condition of an adjacent modular building block. The second end condition 822 of the lintel block 800 is shaped to structurally complement and couple with another end condition of an adjacent modular building block. The first end condition 820 and the second end condition 822 have a tube 824 that completely passing through the first and second end conditions 820, 822. The tube 824 in the first end condition 820 of the lintel block 800 is disposed to align with the tube 824 in another end condition of an adjacent modular building block. The tube 824 in the second end condition 822 of the lintel block 800 is disposed to align with the tube 824 in another end condition of an adjacent modular building block.

The inventor contemplates using cellular lightweight concrete (CLC) to form the lintel blocks 800. This would allow the lintel blocks 800 to be durable, cost effective, fire, mold, and pest resistant, to provide a good thermal and acoustical insulation, to improve air quality and to simplify construction. However, one skilled in the art would recognize that other materials may be used to effectuate a lightweight, strong, durable, and easy to construct modular building block. For example and without limitations a designer may choose a material capable of withstanding forces caused by seismic activity, weather or other harmful factors.

Figure 9:
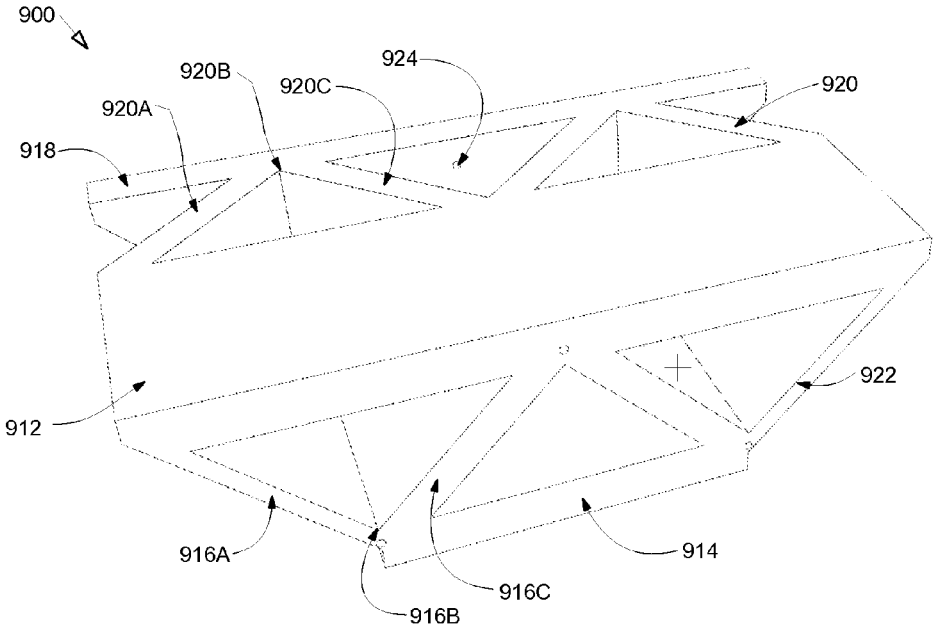
FIG. 9 shows a floor end cap.

FIG. 9 shows a floor end cap 900. The floor end caps 910 have a first wall 912, a second wall 914, a first course 916, a third wall 918, and a second course 920. The first course 1016 is characterized by turns in alternating directions. The course 916 comprises a first length 916A, an angle 916B, and a second length 916C. The first length 916A spans between the first wall 912 and the second opposing wall 914. At the end of the first length 916A, the course 916 turns in the alternate direction having the angle 916B. The course 916 then continues from the angle 916B to span the second length 916C between the first wall 912 and the second opposing wall 914. In FIG. 9, the angle 916B is shown as 90 degrees, however, one skilled in the art would recognize that the course 916 can be constructed to effect other types of structural supports between the first wall 912 and the second wall 914. The span of the course 916, the first and second walls 912, 914 can be lengthened or shorted as needed. The width of the course 916 extends to the intersection of the first wall 912 and the second course 920 so to provide a channel, which allows for air movement between the floor and the walls.

The second course 920 is characterized by turns in alternating directions. The course 920 comprises a first length 920A, an angle 920B, and a second length 920C. The first length 920A spans between the third wall 918 and the first opposing wall 912. At the end of the first length 920A, the course 920 turns in the alternate direction having the angle 920B. The course 920 then continues from the angle 920B to span the second length 920C between the first wall 912 and the third opposing wall 918. In FIG. 9, the angle 920B is shown as 90 degrees, however, one skilled in the art would recognize that the course 920 can be constructed to effect other types of structural supports between the third wall 918 and the first wall 912. The span of the course 920, the first and third walls 912, 918 can be lengthened or shorted as needed.

The floor end cap 900 has an end condition 922. The end condition 122 is shaped to structurally complement and couple with another end condition of an adjacent floor end cap. The floor end cap 900 has a tube 924 that completely passes through at the intersections of the course 916 and either the first or second walls 912, 914. The tube 924 is disposed to align with the tube 924 in an adjacent floor block. The tube 924 offers a channel for a rod (not shown) to provide support between the floor end cap 900 and an adjacent floor block.

Figure 10:
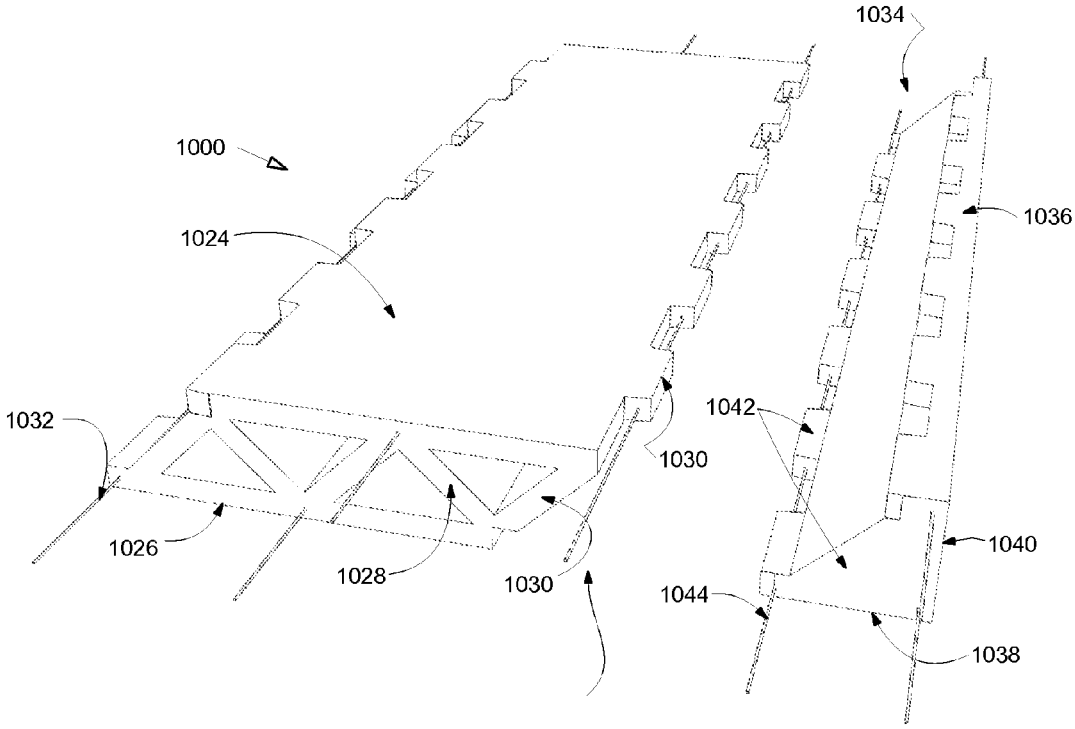
FIG. 10A shows a floor block.
FIG. 10B shows a floor edge block.

FIG. 10A shows a plurality of floor blocks 1000. The floor blocks 1000 have a first wall 1024, a second wall 1026 (not shown), a course 1028, an end condition 1030, and tubes 1032 (not shown). The floor blocks 1000 are constructed in a similar manner as the modular building blocks discussed above.

FIG. 10B shows a floor edge block 1034. The floor edge block 1034 has a first wall 1036, a second opposing wall 1038 (not shown), an end condition 1042, and an end wall 1040. The end condition 1042 is shaped to structurally complement and couple with another end condition of an adjacent floor block. The floor edge block 1034 has a tube 1044 (not shown), which passes completely through the floor edge block 1034. The inventor contemplates using a tube, however, one skilled in the art would recognize other means to effectuate a channel. The tube 1034 is used to provide lateral support between two floor blocks.

Modular Building Block Construction

Figure 11:
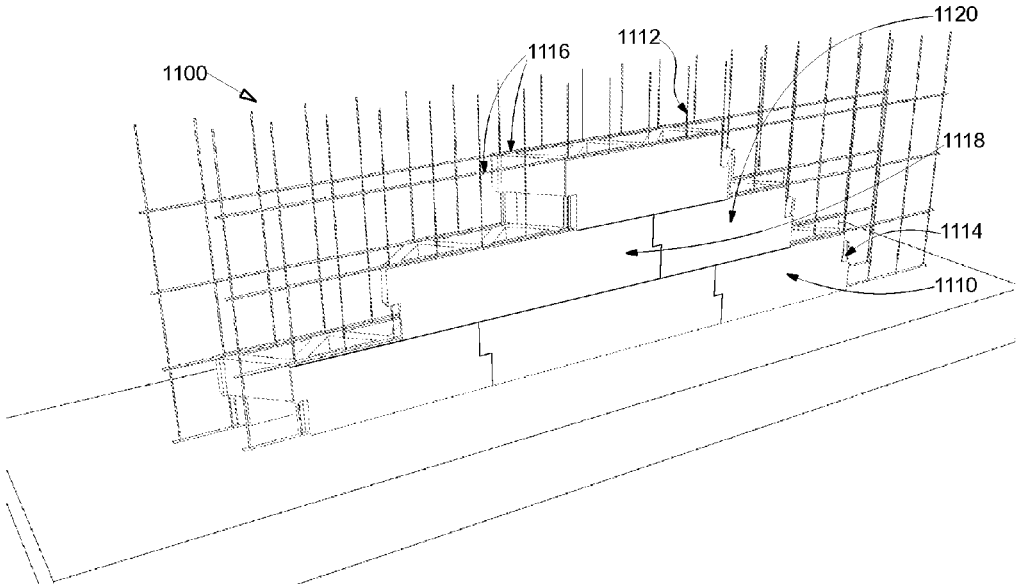
FIG. 11 depicts an assembly of the modular building blocks in a running bond pattern.

FIG. 11 depicts an assembly 1100 of the modular building blocks in a running bond pattern. A first modular building block 1110 is coupled to a second modular building block 1118 using a rod 1112, an end condition 1114 of the modular building block 1110, and a tie strap 1116.

To assemble a structure the rods 1112 are inserted into tubes (not shown in this figure) of the modular building block 1110. The second modular building block 1118 is then positioned so to align the end condition 1114 and the tube of the first modular building block 1110 with the structurally complementary end condition 1114 and the tube of the second modular building block 1118. The tubes (not shown) of the second modular building block 1118 are then guided down the rods 1112 until the end condition 1114 of the second modular building block 1118 couples with the end condition 1114 of the first modular building block 1110. The rods 1112 are then inserted into the second modular building block 1118. The tie straps 1116 are placed on the first and second modular building blocks 1110, 1118 in a recess so that the holes in the tie straps 1116 are aligned with the rods 1112 of the first and second modular building blocks 1110, 1118. This process is repeated until the first tier of modular building blocks is complete.

The second tier is started by aligning the tubes (not shown) of a third modular building block 1120 with the rods 1112 placed in the first and second modular building blocks 1110, 1118. Alignment is made so that when the third modular building block 1120 is guided down the rods 1112, it overlaps both the first and second modular building blocks 1110, 1118. The process above is repeated until the assembly is complete.

Figure 12:
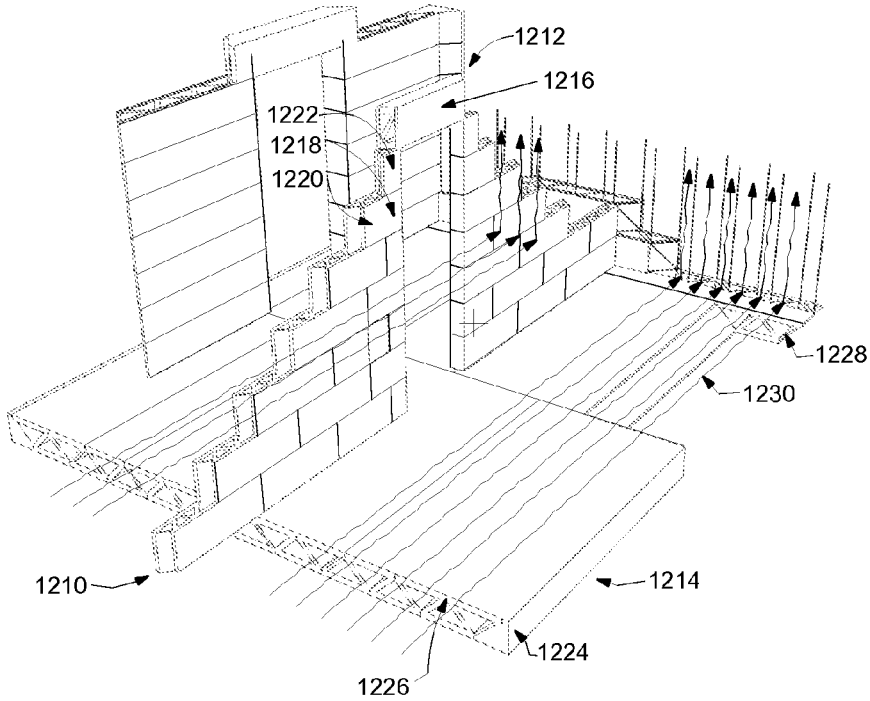
FIG. 12 illustrates an assembly of the modular building blocks into a wall, a doorframe, and flooring.

FIG. 12 illustrates an assembly 1200 of the modular building blocks into a wall 1210, a doorframe 1212, and a flooring 1214. The walls 1210 are assembled similarly as described in FIG. 11. The doorframes 1212 are assembled using a lintel block 1216 and a plurality of jam/end blocks 1218. At the end of the wall 1210 a first jam/end block 1218 is placed so to align the end condition (not shown) and the tube (not shown) with the structurally complementary end condition and the tube of the modular building block 1220. The tubes (not shown) of the first jam/end block 1218 are then guided down the rods (not shown) until the end condition (not shown) of the first jam/end block 1218 couples with the end condition of the modular building block 1220. The rods are then inserted into the first jam/end block 1218. The tie straps (not shown) are placed on the first jam/end block 1218 and the modular building block 1220 in a recess so that the holes in the tie straps are aligned with the rods of the first jam/end block 1218 and the modular building blocks 1220.

The second tier is started by aligning the tubes (not shown) of a second jam/end block 1222 with the rods placed in the first jam/end block 1218 and the modular building block 1220. Alignment is made so that when the second jam/end block 1222 is guided down the rods, it overlaps both the first jam/end block 1218 and the modular building block 1220. The process above is repeated until the vertical post of the door is complete. The top of the frame is completed by coupling the lintel block 1216 with the modular building block 1220 assembled similarly as described in FIG. 11.

The flooring 1214 is assembled first by laying down a floor edge block 1224. A floor block 1226 is then positioned adjacent to the floor edge block 1224 so that the end conditions and tubes (not shown) of both blocks 1224, 1226 align. A rod (not shown) is placed within the tubes to interlock the floor block 1226 and the floor edge block 1224. These steps are repeated for the desired width of the floor. A floor end cap 1228 is positioned so that the tubes (not shown) of the floor end cap 1228 are aligned with the rods (not shown) of the floor block 1226 and the floor edge block 1224. The floor end cap 1228 is then guided down the rods until the floor end cap 1228 is flush with the floor block 1226 and the floor edge block 1224. The rods are then tensioned with a fastener (not shown) to lock together the floor end cap 1228 and the floor block 1226 and the floor edge block 1224. A plurality of air flows 1230 are shown moving between the flooring 1214 and the walls 1210 through the floor end cap 1228.

The above illustration provides many different embodiments or embodiments for implementing different features of the invention. Specific embodiments of components and processes are described to help clarify the invention. These are, of course, merely embodiments and are not intended to limit the invention from that described in the claims.

The attached appendix includes amplifying illustrations and alternative views and is incorporated by reference as if fully set forth herein.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A device comprising:

a first wall, said first wall including a first lateral support disposed lengthwise on a first surface and a second lateral support disposed lengthwise on a second surface, wherein said first lateral support of said first wall includes an extended portion, and said second lateral support of said first wall includes a recess, said first wall including at least one channel extending from the first surface to the second surface;

a second wall, said second wall including a first lateral support disposed lengthwise on a first surface and a second lateral support disposed lengthwise on a second surface, wherein said first lateral support of said second wall includes an extended portion, and said second lateral support of said second wall includes a recess, said second wall including at least one channel extending from the first surface to the second surface;

a course disposed between and coupled to said first wall and said second wall, said course characterized by one or more turns, wherein a first length of said course is disposed between the first and second wall at a 45 degree angle and a second length is disposed from said first length at a 90 degree angle;

at least one end condition, said end condition including a partial-height element disposed along said course, whereby said partial-height element is matchable with an inverse thereof;

a reinforcing assembly disposed inside said first wall, said course, and said second wall, wherein said reinforcing assembly includes:

a plurality of wire mesh portions having one or more first portions disposed substantially in a planar manner along at least a part of said first wall and having one or more second portions disposed substantially in an undulating manner along at least a part of said course in a region where said course meets said first wall, interpenetrating to form one or more interlocks and disposed to define a void between said first portions and said second portions, said void defining an elongated space having an axis, said one or more interlocks disposed about the channels, capable of restraining a vertical element when positioned therebetween from movement in an XY plane substantially transverse from said axis, and capable of having their movement restrained in said XY plane by said vertical element when positioned therebetween, wherein the one or more interlocks provides structural support for the channels in response to compression between a straight part of at least one of said one or more first portions and a bent part of at least one of said one or more second portions.

2. The device of claim 1 further comprising a plurality of vertical retainer members having a size smaller than said channel.

3. The device of claim 2 wherein said vertical retainer members includes a plurality of fasteners.

4. The device of claim 1 further comprising a plurality of lateral retainer members, wherein said lateral retainer members are disposed in said recesses.

5. The device of claim 1 wherein a chase is disposed in the course and the reinforcing assembly.

6. A device comprising:

a first wall, said first wall including a first lateral support disposed lengthwise on a first surface and a second lateral support disposed lengthwise on a second surface, said first wall including at least one channel extending from the first surface to the second surface;

a course coupled to said first wall, said course characterized by one or more turns;

a second wall coupled to said course, said second wall including a first lateral support disposed lengthwise on a first surface and a second lateral support disposed lengthwise on a second surface, said second wall including at least one channel extending from the first surface to the second surface;

at least one end condition, said end condition including a partial-height element disposed along said course, whereby said partial-height element is matchable with an inverse thereof; and a reinforcing assembly disposed inside said first wall, said course, and said second wall, wherein said reinforcing assembly includes:

a plurality of wire mesh portions having one or more first portions disposed substantially in a planar manner along at least a part of said first wall and having one or more second portions disposed substantially in an undulating manner along at least a part of said course in a region where said course meets said first wall, interpenetrating to form one or more interlocks and disposed to define a void between said first portions and said second portions, said void defining an elongated space having an axis.

7. The device of claim 6 further including a reinforcing assembly disposed inside said first wall, said course, and said second wall.

8. The device of claim 7 wherein said reinforcing assembly includes:

a plurality of wire mesh portions disposed to form one or more interlocks having one or more first portions disposed along at least a part of said first wall and having one or more second portions disposed along at least a part of said course in a region where said course meets said first wall, said one or more interlocks disposed about the channels, wherein the one or more interlocks provides structural support for the channels in response to compression between a straight part of at least one of said one or more first portions and a bent part of at least one of said one or more second portions.

9. The device of claim 7 wherein a chase is disposed in the course and reinforcing assembly.

10. The device of claim 6 further comprising a plurality of vertical retainer members having a size smaller than said channel.

11. The device of claim 10 wherein said vertical retainer members includes a plurality of fasteners.

12. The device of claim 6 wherein said lateral supports are recesses disposed for receiving lateral retainer members.

13. The device of claim 6 wherein the first lateral support is a raised portion and the second lateral support is a dimple.

* * * * *